US005083157A

United States Patent [19]

Smith et al.

[11] Patent Number: 5,083,157

[45] Date of Patent: Jan. 21, 1992

[54] APPLICATION OF MICR MEDIA TO XEROGRAPHIC IMAGES

[75] Inventors: Wayne R. Smith, Pittsford; William A. Sullivan, Webster, both of N.Y.

[73] Assignee: Xerox Corporation, Stamford, Conn.

[21] Appl. No.: 630,907

[22] Filed: Dec. 20, 1990

[51] Int. Cl.[5] ..... G03G 15/00

[52] U.S. Cl. ..... 355/200; 118/202; 118/204; 346/74.2; 430/106.6; 355/245

[58] Field of Search ..... 355/200, 202, 245, 77, 355/133; 101/DIG. 37; 430/39, 97, 106.6; 346/74.2; 118/202, 204

[56] References Cited

U.S. PATENT DOCUMENTS 4,563,086 1/1986 Knapp et al. ..... 355/14 D
4,581,283 4/1986 Tokusaga et al. ..... 428/216
4,891,240 1/1990 Ward et al. ..... 427/11
4,901,114 2/1990 Parker et al. ..... 355/245
4,924,263 5/1990 Bares ..... 355/203
5,036,362 7/1991 Stelter ..... 355/245

*Primary Examiner*—R. L. Moses
*Attorney, Agent, or Firm*—William A. Henry, II

[57] ABSTRACT

A low cost and efficient system for magnetic ink character recognition provides a magnetic image over a non-magnetic toned image which can be an on-line or off-line component of an imaging apparatus. Magnetic ink is applied to selected characters from a thin film that includes a magnetic media by utilizing a heater member to promote release of the magnetic ink to the previously toned characters.

20 Claims, 2 Drawing Sheets

APPLICATION OF MICR MEDIA TO XEROGRAPHIC IMAGES

Copending and commonly assigned U.S. application Ser. No. 07/630,901 by Gerald Abowitz et al. filed Dec. 20, 1990, and entitled improved Security of Negotiable Instruments thru the Application of Color to Xerographic Images is hereby cross-referenced and incorporated herein by reference.

The present invention relates generally to an electrophotographic printing machine, and more particularly concerns an apparatus for the application of magnetic ink character recognition media to previously toned xerographic images.

In general, the process of electrophotographic printing includes charging a photoconductive member to a substantially uniform potential to sensitize the surface thereof. The charged portion of the photoconductive surface is exposed to a modulated light beam, i.e., a laser beam, may be utilized to discharge selected portions of the charged photoconductive surface to record the desired information thereon. In this way, an electrostatic latent image is recorded on the photoconductive surface which corresponds to the electrostatic latent image on the photoconductive member, the latent image is developed by bringing developer material into contract therewith. Generally, developer material is comprised of toner particles adhering triboelectrically to carrier granules. The carrier granules are magnetic, while the toner particles may or may not contain small amounts of magnetic media encapsulated in a thermoplastic resin binder. The toner particles are electrostatically attracted from the carrier granules to a copy sheet. Alternatively, single component development could be used. Finally, the copy sheet is heated to permanently affix the toner image to the copy sheet.

Electrophotographic printing has been particularly useful in the commercial banking industry by reproducing checks or financial documents with magnetic ink, i.e., by fusing magnetically loaded toner particles thereon. Each financial document has imprinted thereon encoded data in a magnetic ink character recognition (MICR) format. In addition, high speed processing of financial documents is simplified by imprinting magnetic ink bar codes in machine readable form thereon. The repeated processing of the financial documents and the high speed sorting thereof is greatly simplified by the reading of the encoded data by an MICR reader. Thus, encoded information on financial documents may be imprinted thereon xerographically with magnetic ink or toner. The information reproduced on the copy sheet with the magnetic particles may be subsequently read due to its magnetic and optical characteristics. Hereinbefore, high speed electrophotographic printing machines have employed magnetic toner particles to develop the latent image. These toner particles have been subsequently transferred to the copy sheet and fused thereto. The resultant document may have variable or fixed magnetic data imprinted thereon in MICR format which is subsequently read by a MICR reader and processed. Thus while the utilization of magnetically encoded information on documents reproduced with magnetic particles is well known, the cost of using magnetic toner as the only developer in a printer is substantial since every copy going through the printer uses up magnetic toner whether the subsequent copy is to be read by an MICR reader or not. Therefore, ways are needed to reduce this cost.

For example, U.S. Pat. No. 4,901,114 discloses an MICR toner used in combination with a non-MICR toner. The combination of using MICR toner and standard toner enables one to print some parts of an image with MICR toner and the remainder with non-MICR toner. A heat sensitive magnetic transfer element for printing a magnetic image is disclosed in U.S. Pat. No. 4,581,283. The magnetic transfer element includes a heat resisting foundation and a heat sensitive transferring layer. A means of transferring a magnetic image to a substrate is also shown. U.S. Pat. No. 4,891,240 discloses a magnetic ink recognition coating system. The coating system includes means to provide a lubricant that is applied solely in the area where the MICR characters are printed. An electrophotographic printing machine is disclosed in U.S. Pat. No. 4,563,086 where a magnetic toner image is transferred to a copy sheet. Electrophotographic printing is sued for reproducing checks or financial documents with magnetic ink by fusing magnetic toner particles thereon. All of the above-mentioned patents are included herein by reference to the extent necessary to practice the present invention.

In accordance with the present invention, there is provided an electrophotographic printing machine of the type in which a non-magnetic toner image is transferred to a copy sheet from a photoconductive member and fused thereto. The toner image may be slightly magnetic, if desired. Means are provided for the production of magnetic characters from a thin film comprising a magnetic media by utilizing a heater member to selectively apply the durable magnetic media only to those images of the copy sheet that are intended to be read by a magnetic ink character recognition reader. The embodiment of durability enhancing resins, color and opacity of the present invention serves to lower infield reader/sorter reject rates beyond that achieved by present magnetic toner systems.

The foregoing and other features of the instant invention will be more apparent from a further reading of the specification, claims and from the drawings in which:

Figure 1:
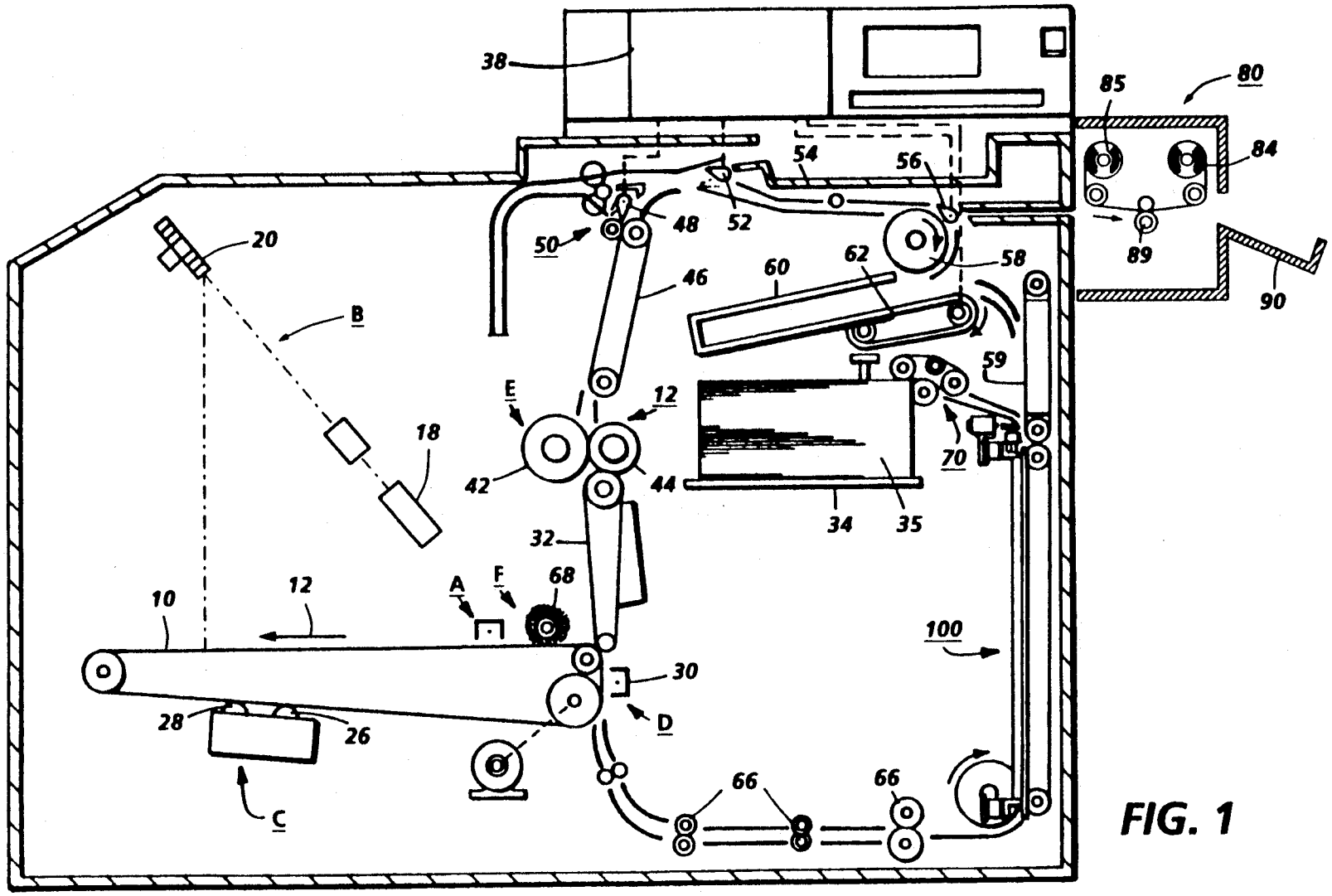
FIG. 1 is a schematic elevational view showing an electrophotographic copier employing the features of an aspect of the present invention.

For a general understanding of the features of the present invention, reference is had to the drawings. In the drawings, like reference numerals have been used throughout to designate identical elements. FIG. 1 schematically depicts the various components of an illustrative electrophotographic printing machine incorporating the improved method and apparatus for creating MICR readable images by applying magnetic media to non-magnetic toner of the present invention therein.

Inasmuch as the art of electrophotographic printing is well known, the various processing stations employed in the FIG. 1 printing machine will be shown hereinafter schematically and their operation described briefly with reference thereto.

As shown in FIG. 1, the illustrative electrophotographic printing machine employs a belt 10 having a photoconductive surface thereon. Preferably, the photoconductive surface is made from a selenium or an amorphous silicon organic photoconductive surface could be used. Belt 10 moves in the direction of arrow 12 to advance successive portions of the photoconductive surface through the various processing stations disposed about the path of movement thereof.

Initially, a portion of the photoconductive surface passes through charging station A. At charging station A, a corona generating device charges the photoconductive surface to a relatively high substantially uniform potential.

Next, the charged portion of the photoconductive surface is advanced through imaging station B. At imaging station B, a laser 18, on command from a computer and through the used of polygon 20, images photoconductive surface 12 as disclosed in U.S. Pat. No. 4,782,363. This records an electrostatic latent image on the photoconductive surface which corresponds to the computer generated information. Thereafter, belt 10 advances the electrostatic latent image recorded on the photoconductive surface to the development station C.

With continued reference to FIG. 1, at development station C, a pair of magnetic brush developer rollers, indicated generally by the reference numerals 26 and 28, advance a standard non-magnetic developer material into contact with the electrostatic latent image. The latent image attracts toner particles from the carrier granules of the developer material to form a toner powder image on the photoconductive surface of belt 10.

After the electrostatic latent image recorded on the photoconductive surface of belt 10 is developed, belt 10 advances the toner powder image to transfer station D. At transfer station D, a copy sheet is moved into contact with the toner powder image. Transfer station D includes a corona generating device 30 which sprays ions onto the backside of the copy sheet. This attracts the toner powder image from the photoconductive surface of belt 10 to the sheet. After transfer, conveyor 32 advances the sheet to fusing station E.

The copy sheets are fed from tray 34 to transfer station D. The tray senses the size of the copy sheets and sends an electrical signal indicative thereof to a microprocessor within controller 38. Similarly, the holding tray of document handling unit 15 includes switches thereon which detect the size of the original document and generate an electrical signal indicative thereof which is transmitted also to a microprocessor controller 38.

Fusing station E includes a fuser assembly, indicated generally by the reference numeral 40, which permanently affixes the transferred powder image to the copy sheet. Preferably, fuser assembly 40 includes a heated fuser roller 42 and backup roller 44. The sheet passes between fuser roller 42 and backup roller 44 with the powder image contacting fuser roller 42. In this manner, the powder image is permanently affixed to The sheet.

After fusing, conveyor 46 transports the sheets past a magnetic media applicator 80 for selectively overcoating parts of the sheets and then to gate 48 which functions as an inverter selector. Depending upon the position of gate 48, the copy sheets will either be deflected into a sheet inverter 50 or bypass sheet inverter 50 and be fed directly onto a second decision gate 52. Thus, copy sheets which bypass inverter 50 turn a 90° corner in the sheet path before reaching gate 52. Gate 48 directs the sheets into a face up orientation so that the imaged side which has been transferred and fused is face up. If inverter path 50 is selected, the opposite is true, i.e., the last printed face is facedown. Second decision gate 52 deflects the sheet directly into an output tray 54 or deflects the sheet into a transport path which carries it on without inversion to a third decision gate 56. Gate 56 either passes the sheets directly on without inversion into the output path of the copier, or deflects the sheets into a duplex inverter roll transport 58. Inverting transport 58 inverts and stacks the sheets to be duplexed in a duplex tray 60 when gate 56 so directs. Duplex tray 60 provides intermediate or buffer storage for those sheets which have been printed on one side and on which an image will be subsequently printed on the side opposed thereto, i.e., the copy sheet being duplexed. Due to the sheet inverting by rollers 58, these buffers set sheets are stacked in duplex tray 60 facedown. They are stacked in duplex tray 60 on top of one another in the order in which they are copied.

In order to complete duplex copying, the previously simplexed sheets in tray 60 are fed to conveyor 59 seriatim by bottom feeder 62 back to transfer station D for transfer of the toner powder image to the opposed side of the sheet. Conveyors 100 and 66 advance the sheet along a path which produces an inversion thereof. However, inasmuch as the bottommost sheet is fed from duplex tray 60, the proper or clean side of the copy sheet is positioned in contact with belt 10 at transfer station D so that the toner powder image thereon is transferred thereto. The duplex sheets are then fed through the same path as the previously simplexed sheets to be stacked in tray 54 for subsequent removal by the printing machine operator.

Returning now to the operation of the printing machine, invariably after the copy sheet is separated from the photoconductive surface of belt 10, some residual particles remain adhering to belt 10. These residual particles are removed from the photoconductive surface thereof at cleaning station F. Cleaning station F includes a rotatably mounted fibrous brush 68 in contact with photoconductive surface of belt 10. These particles are cleaned from the photoconductive surface of belt 10 by the rotation of brush 68 in contact therewith. Subsequent to cleaning, a discharge lamp (not shown) floods the photoconductive surface with light to dissipate any residual electrostatic charge remaining thereon prior to the charging thereof for the next successive imaging cycle.

Figure 2:
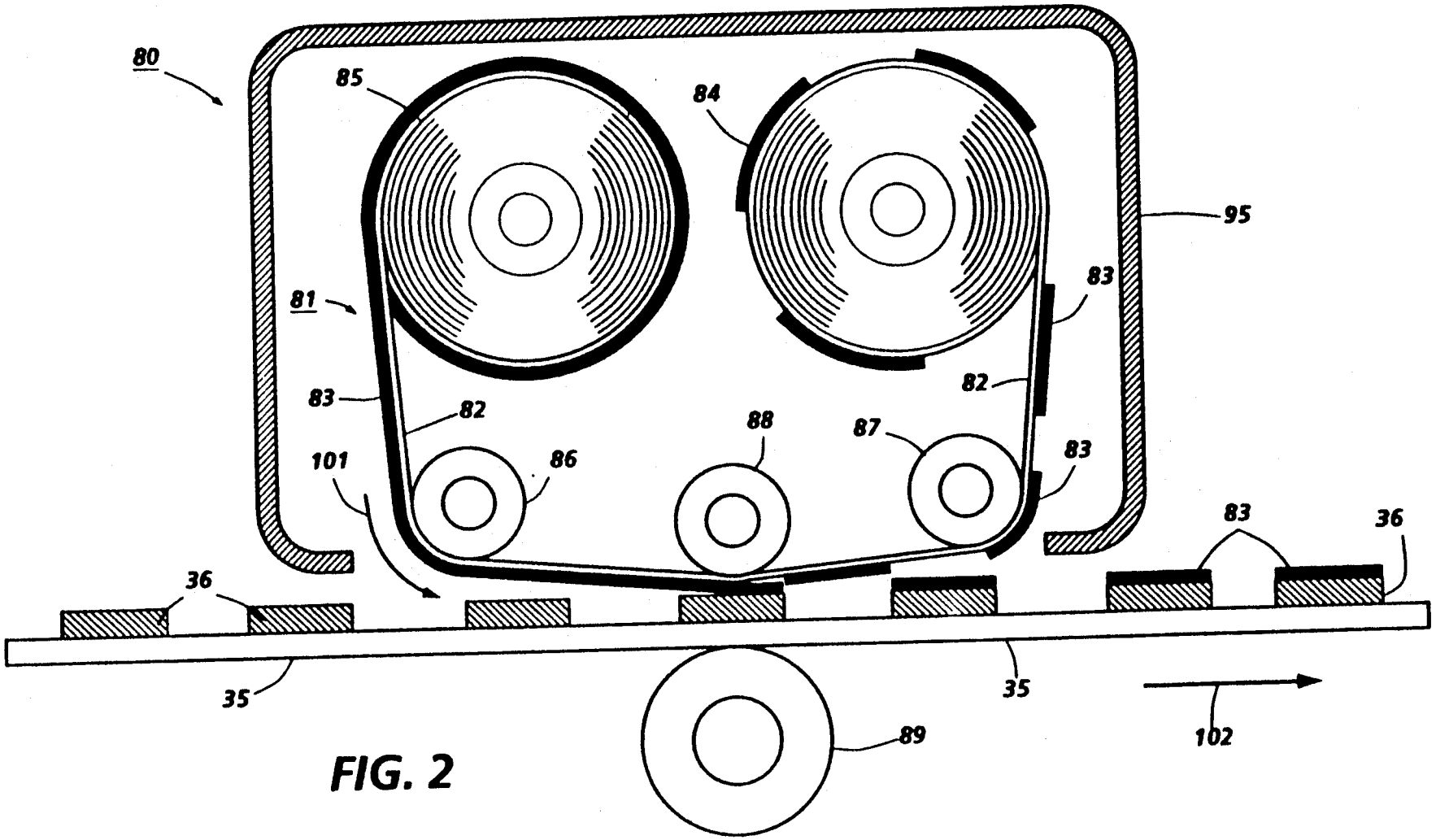
FIG. 2 shows a side view of the magnetizing device of the present invention employed in FIG. 1 in the process of magnetic overcoating onto non-magnetic toner as is part of the present invention.

Turning now to an aspect of the present invention, and in reference to FIGS. 1 and 2, magnetic media applicator 80 is positioned to apply a magnetic media to selected parts of the sheets 35. When these sheets contain, for example, checks with four (4) on each sheet, the numbers or code along the bottom of any sheet are overcoated with a magnetic media as shown in FIG. 2 which makes the codes machine readable. The checks can now be passed through a machine called a reader-sorter by the bank processing any of the checks with the number and symbols now being recognizable.

Magnetic media applicator 80 comprises a conventional fuser 88 mounted against the back of thin film 81. Film 81 comprises a heat resistant polyester film backing member 82, such as, Mylar with a layer of magnetite 83 adhered thereto and is positioned to contact sheets deflected in its direction by gate 56. The composition of magnetite layer 83 found to produce desired results preferably comprises iron oxide, carbon black, styrene, chlorinated rubber, mirasil and plastolein with each having a percent dried weight of 58.8, 6.4, 25.2, 7.3, 2.0 and 0.3, respectively. Film 81 is contained within a cassette 95 and wound up onto a pay-out spool 84 and connected to a take-up spool 85 at one end thereof after passing tensioning rollers 86 and 87, respectfully, with fuser 88 being positioned between the two spools 84 and 85 facing the backing member 82 and opposite a backup roller 89. Sheets 35 with the codes and symbols desired to be magnetized are located directly below fuser 88 which heats and presses film 81 against previously fused non-magnetic toner 36. The heat causes the magnetite that is directly over standard toner characters to release from the backing member and adhere to the previously fused characters while the copy sheet continues en route toward output tray 90. It should be understood that this invention is also intended for use with a sensing system as disclosed in U.S. Pat. No. 4,891,240 where the code to be magnetized would be sensed, a circular heating shoe rotating at the speed of the copy sheets would be brought into contact with film 81 moving at the speed of the copy sheets and the shoe removed from the film once the code is sensed as having passed the magnetic media loading point.

It should be understood that multiple lines of coded material could be magnetized with the present magnetizing process by including multiple cassettes of tape positioned as desired. Further, while magnetic media applicator is disclosed herein as an on-line device, i.e., one that is connected to and accepts sheets from a copier/printer as they leave the copier/printer, one can readily see that the magnetic media applicator is adaptable to off-line use as well. In short, magnetic media application 80 is adaptable for both on-line and off line applications and provides magnetic ink character readable images on demand.

In recapitulation, it is evident that the apparatus of the present invention applies magnetic media to non-magnetic toned images by heating one surface of a film containing a layer of magnetite material and pressing the opposite surface of the film onto the non-magnetic toned image, whereby only the desired image characters are magnetized resulting in a lower cost and more efficient MAGNETIC INK CHARACTER RECOGNITION system.

It is therefore, apparent that there has bene provided, in accordance with the present invention, an apparatus for applying MAGNETIC INK CHARACTER RECOGNITION media to xerographic images within a printing machine as a function thereof. This apparatus fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to cover all such alternatives, modifications, and variations as fall within the spirit and broad scope of the appended claims.

What is claimed is:

1. In an electrophotographic printing machine of the type in which a non-magnetic toner image is transferred to a copy substrate from a photoconductive member and fused thereto, the improvement for creating MICR readable images out of the previously fused non-magnetic images, comprising:

a substrate containing non-magnetic images on a surfaces thereof;

a film including a heat resistant backing member and a magnetite media adhered thereto; and a heater member positioned adjacent said backing member and adapted to contact said backing member and press said magnetite media against predetermined portions of said non-magnetic images in order to heat the same and thereby cause said magnetite media to fuse to said non-magnetic images and thereby render the resultant images readable by MICR readers.

2. The improvement of claim 1, wherein said film is positioned within a cassette.

3. The improvement of claim 2, wherein said cassette includes at least two tension rollers adapted to tension and position said film.

4. The improvement of claim 3, wherein said cassette is adapted to position said film to contact said substrate only at a predetermined location.

5. The improvement of claim 4, wherein said predetermined location is adjacent said heater member.

6. The improvement of claim 5, wherein said film within said cassette is unwound from a play-out spool and after use wound upon a take-up spool.

7. A method for creating MICR readable images out of previously fused non-magnetic images, comprising the steps of:

providing a substrate containing non-magnetic images on a surface thereof;

providing a film including a heat resistant backing member with a magnetite media adhered thereto; and providing a heater member positioned adjacent said backing member;

moving said substrate containing non-magnetic images on a surface thereof into contact with said backing member;

pressing said magnetite media against predetermined portions of said non-magnetic images; and heating said magnetite media with said heater member in order to thereby cause said magnetite media to fuse to said non-magnetic images and thereby render the resultant images readable by MICR readers.

8. The method of claim 7, including the step of providing a cassette with said film positioned within said cassette.

9. The method of claim 8, including the step of providing said cassette with at least two tension rollers adapted to tension and position said film.

10. The method of claim 9, including the step of unwinding said film from a play-out spool and after use winding it upon a take-up spool.

11. A method of providing MICR images, including the steps of:

providing a substrate containing non-magnetic images on a surface thereof; and fusing magnetite on top of said non-magnetic images.

12. An apparatus for creating images readable by a MICR reader-sorter, comprising:

a first substrate having a heat releasable magnetic material attached thereto; and fuser means for heating and pressing said magnetic material onto non-magnetic toned images of a second separate substrate in order to thereby cause said magnetic material to fuse to said non-magnetic images of said second substrate and thereby render the resultant images readable by a MICR reader-sorter.

13. The apparatus of claim 12, wherein said first substrate is a film comprising a heat resistant backing layer and a layer of magnetic material.

14. The apparatus of claim 13, wherein said fuser means includes a fuser roller and a backup roller and wherein said fuser roller is positioned adjacent said heat resistant backing layer of said film.

15. The apparatus of claim 14, wherein said film is positioned within a cassette.

16. The apparatus of claim 15, wherein said cassette includes at least two tension rollers adapted to tension and position said film.

17. The improvement of claim 16, wherein said cassette is adapted to position said film to contact said second substrate only at a predetermined location.

18. The apparatus of claim 17, wherein said predetermined locations is adjacent said heater member.

19. The apparatus of claim 18, wherein said film within said cassette is unwound from a play-out spool and after use wound upon a take-up spool.

20. In an electrophotographic printing machine of the type in which a non-magnetic toner image is transferred to a copy substrate from a photoconductive member and fused thereto, the improvement for creating MICR readable images out of the previously fused non-magnetic images, comprising:

a first substrate having a heat releasable magnetic material attached thereto; and fuser means for heating and pressing said magnetic material onto non-magnetic toned images of a second separate substrate in order to thereby cause said magnetic material to fuse to said non-magnetic images of said second substrate and thereby render the resultant images readable by a MICR reader-sorter.

* * * * *